US005975712A

United States Patent [19]

Shiao

[11] Patent Number: 5,975,712

[45] Date of Patent: Nov. 2, 1999

[54] TELESCOPIC ILLUMINATING TOOL

[76] Inventor: Hsuan-Sen Shiao, No. 15-1, Lane 369, Min-Chuan Rd., Taichung, Taiwan

[21] Appl. No.: 09/212,376

[22] Filed: Dec. 16, 1998

[51] Int. Cl.[6] ..... B25B 23/18

[52] U.S. Cl. ..... 362/120; 362/198; 362/206

[58] Field of Search ..... 362/119, 120, 362/198, 285, 418, 206

[56] References Cited

U.S. PATENT DOCUMENTS 5,381,319 1/1995 Shiao ..... 362/120
5,647,623 7/1997 Shiao ..... 362/120 X

*Primary Examiner*—Stephen Husar
*Attorney, Agent, or Firm*—Foley & Lardner

[57] ABSTRACT

A telescopic illuminating tool includes a handle with an accommodating chamber for receiving a battery unit, and first and second electric contacts spaced apart each other. A plurality of telescopic metal concentric tubes is connected to a head of the handle at one end and, is provided with a bulb seat at an opposite end. The bulb seat has a contact area in electrical contact with a ring contact of an electric bulb, and a third electric contact in electrical contact with the concentric tubes. A stretchable electrically conductive member, such as a tension spring with an electrically insulative sheath thereon, is secured in the concentric tubes for connection with a tip contact of the bulb and a first electric contact of the handle which, in turn, is adapted to be in electrical contact with one electrode of the battery unit. A second electric contact of the handle is in electrical contact with the concentric tubes and the other electrode of the battery unit. The stretchable electrically conductive member can be stretched or retracted when the concentric tubes are extended or shortened, thereby adjusting desirably the length of the illuminating tool.

8 Claims, 8 Drawing Sheets

TELESCOPIC ILLUMINATING TOOL

BACKGROUND OF THE INVENTION

1. Field of the Invention

This invention relates to a telescopic illuminating tool, more particularly to a telescopic illuminating tool with telescopic tubes and a stretchable electrically conductive wire disposed in the telescopic tubes for electrical connection with a battery unit and an electric bulb.

2. Description of the Related Art

Referring to FIG. 1, a conventional illuminating tool is shown to include a conductive barrel housing 1 for receiving a battery unit 2, a press button 3 which is disposed outwardly of a rear end of the housing 1, and a flexible core 4 which has an end connected to a front end of the housing 1, and the other end provided with an electric bulb 5 and a tool member 6. The electric bulb 5 is lighted by the battery unit 2, and the flexible core 4 can be adjusted at any desired angle. However, the flexible core 4 can not be adjusted in length, thereby resulting in inconvenience during use.

Referring to FIG. 2, another conventional illuminating tool is shown to include a plurality of metal tubes 11 which are fitted telescopically and slidably with one another, a switch member 12, a battery receiving tube 14 for receiving battery cells 13, and a plurality of spiral conducting wires 17, each received in the respective metal tube 11. Since the conducting wires 17 are made of enameled wires which are difficult to be stretched, the extension range of the illuminating tool is limited.

SUMMARY OF THE INVENTION

The object of the present invention is to provide a telescopic illuminating tool which has a stretchable electrically conducting member made of a single conducting wire and received in telescopically concentric tubes so as to be stretched or retracted when the tubes are extended or shortened, thereby adjusting the illuminating tool in length when desired.

According to this invention, a telescopic illuminating tool includes a hollow handle which has an accommodating chamber for receiving a battery unit, and first and second electric contacts which are insulatively spaced apart from each other and which are adapted to be connected electrically and respectively with the two electrodes of the battery unit. A plurality of electrically conductive concentric tubes are fitted telescopically and slidably one within another, and form an opened second head end, an opposite opened second tail end, and a through hole extending therethrough. The opened second tail end engages a first head end of the handle, and is electrically connected to the second electric contact. A bulb seat is connected to the opened second head end, and defines a contact area and a third electric contact which is spaced apart from the contact area. The third electric contact is in electric connection with the opened second head end. A stretchable electrically conductive member is disposed securely in the through hole, and is insulated from the electrically conductive concentric tubes. The stretchable electrically conductive member has a front end which extends into the contact area of and which is secured relative to the bulb seat to form a fourth electric contact, and an opposite rear end which is connected to the first electric contact. As such, the stretchable electrically conductive member will be stretched or retracted when the electrically conductive concentric tubes are extended or shortened. An electric bulb is disposed in the bulb seat to be lighted via an electrical contact between the third electric contact and the fourth electric contact. A tool member is disposed to be spaced from and forwardly of the electric bulb.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
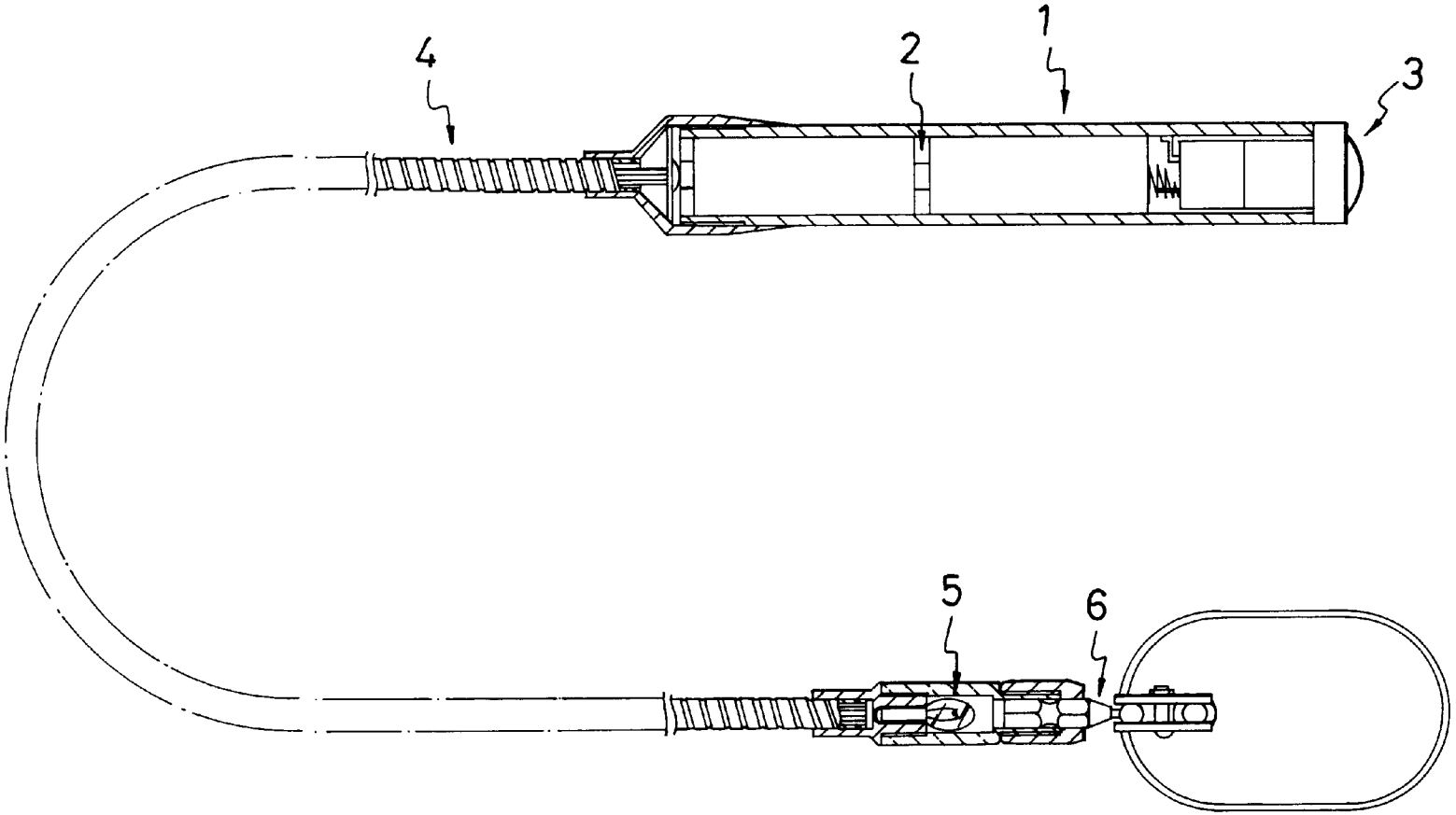
FIG. 1 PRIOR ART
FIG. 1 is an assembled, partly sectional view of a conventional illuminating tool.
Figure 2:
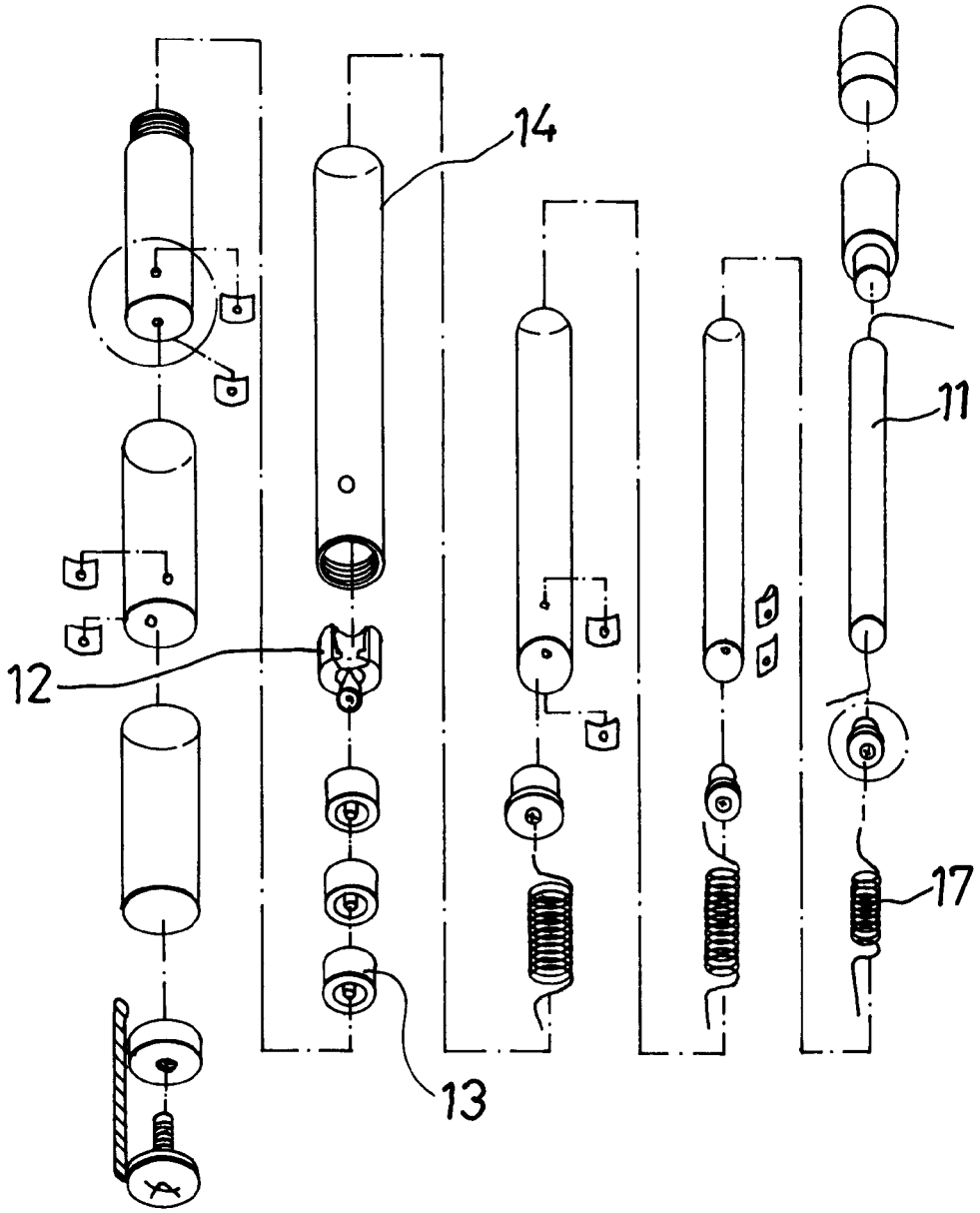
FIG. 2 PRIOR ART
FIG. 2 is an exploded view of another conventional illuminating tool.
Figure 3:
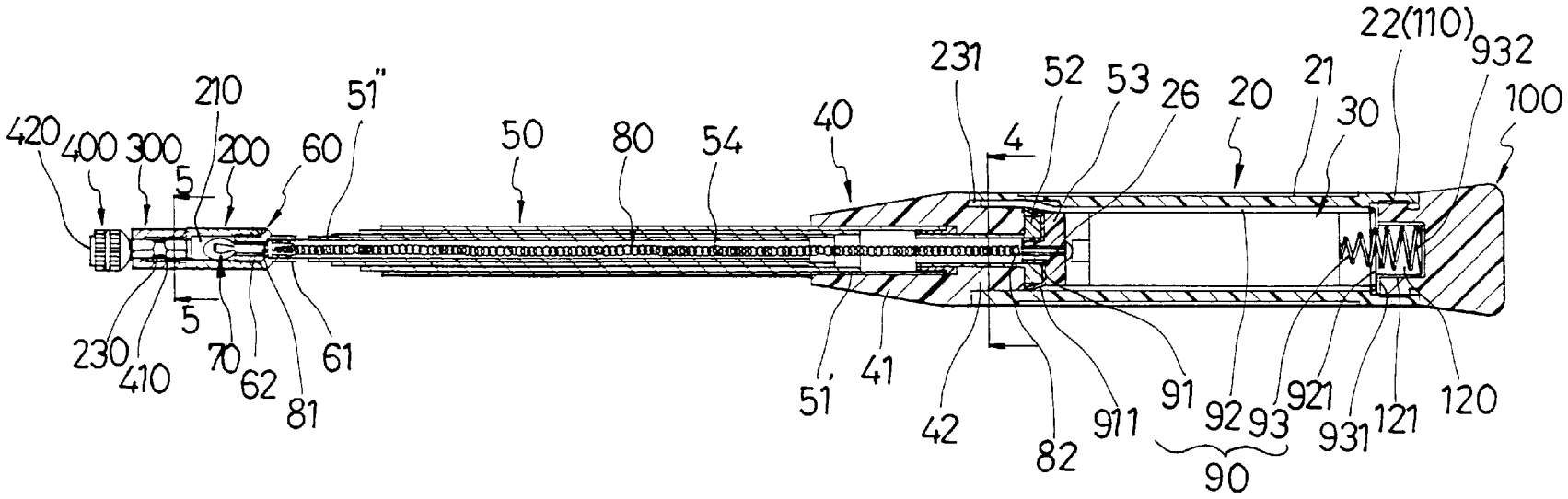
FIG. 3 is a sectional view of a preferred embodiment of a telescopic illuminating tool according to this invention.

Referring to FIG. 3, the preferred embodiment of a telescopic illuminating tool according to the present invention is shown to comprise an elongate handle 20, an electrically insulative connecting member 40, a plurality of electrically conductive concentric tubes 50, an electrically conductive bulb seat 60, a stretchable electrically conductive member 80, an electric bulb 70, a tool member, and a switch member 100.

Figure 4:
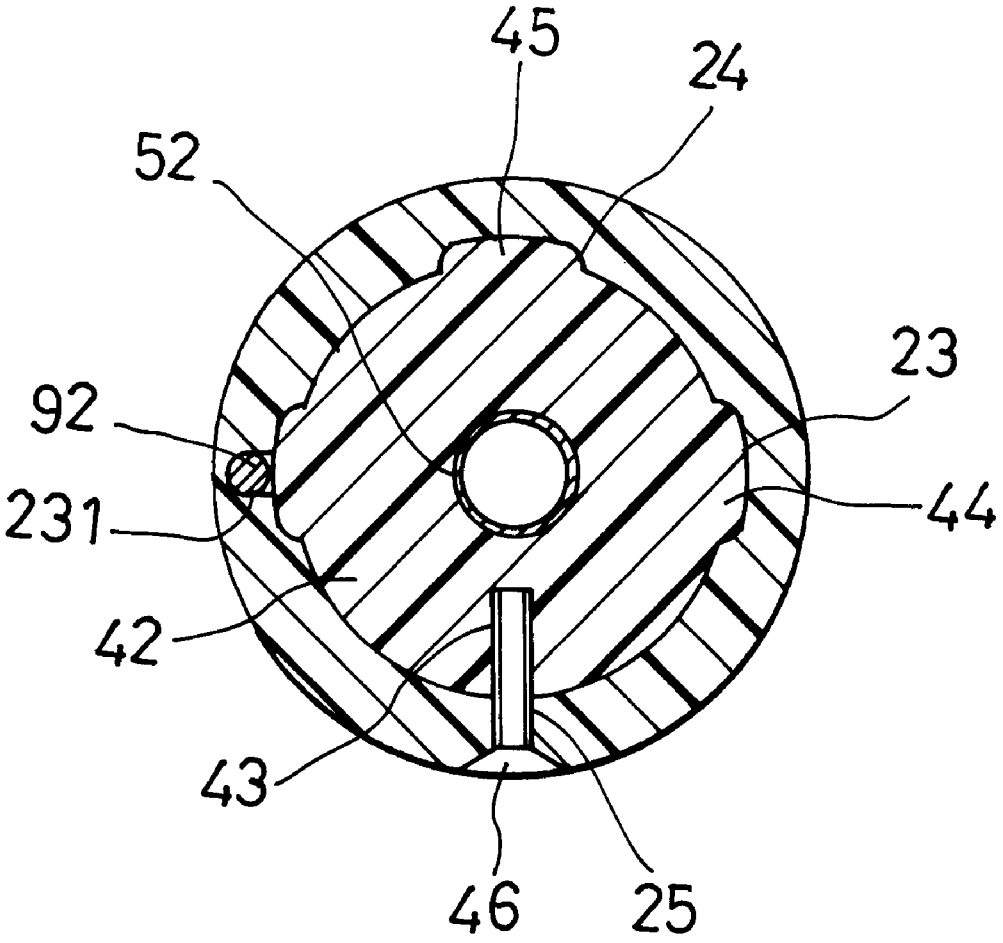
FIG. 4 is a partial cross-sectional view of the telescopic illuminating tool shown in FIG. 3, taken along lines 4—4 thereof.

The handle 20 is made of a plastic material, and has a first head end, a first tail end opposite to the first head end in an axial direction and with an inner threaded wall 22, an accommodating chamber which is interposed between the first head and tail ends for receiving a battery 30, a first electric contact 26 which is disposed on the first head end and at a location in the axial direction, and a second electric contact 90 (described hereinafter in detail) which is disposed to be insulatively spaced apart from the first electric contact 26 in a radial direction. The first and second electric contacts 26, 90 are adapted to be connected electrically and respectively with two electrodes of the battery 30. The handle 20 has a splined outer wall 21 to facilitate gripping thereof. With reference to FIG. 4, two side grooves 23 and an upper groove 24 are formed in an inner wall of the handle 20 parallel to the axial direction. The first head end of the handle 20 further has an axial mounting groove 231 which is formed to flank one of the side grooves 23, and a screw hole 25 which is formed transverse to the axial direction.

The connecting member 40 has a front portion 41 which tapers gradually and forwardly, and a rear portion 42 which is connected to the first head end of the handle 20. The rear portion 42 has two side engaging plugs 44 and an upper plug 45 (see FIG. 4) which are formed axially and which are fitted in the corresponding grooves 23, 24 of the handle 20. The rear portion 42 further has a screw hole 43 which is formed transverse to the axial direction such that a screw fastener 46 engages threadedly the screw holes 25, 43. In addition, the connecting member 40 has a passage which extends therethrough in the axial direction for passage of the first electric contact 26.

The concentric tubes 50 are fitted telescopically and slidably one within another, and form an opened second head end 51", an opened second tail end 51' opposite to the opened second head end 51" in the axial direction, and a through hole 54 which extends through the opened second head and tail ends 51", 51' and which is communicated with the passage of the connecting member 40. The opened second tail end 51' engages securely the connecting member 40 via a hollow electrically conductive fastener 52. An electrically insulative block 53 is disposed between the fastener 52 and the accommodating chamber of the handle 20 to electrically insulate the fastener 52 and the battery 30, and has a hole for passage of the first electric contact 26 into the through hole 54 of the concentric tubes 50.

The bulb seat 60 is connected to the opened second head end 51", and has an inner threaded wall 62 to define a contact area around the axial direction to be communicated with the through hole 54, and a connecting portion 61 which is disposed to be spaced apart from the inner threaded wall 62 to be connected to the opened second head end 51" and to confine a third electric contact in electrical connection with the opened second head end 51".

The stretchable electrically conductive member 80 is an electrically conductive tension spring wire which is sheathed with an electrically insulative sheath, and is disposed securely in the through hole 54. The electrically conductive member 80 has a front end which extends into the contact area of the bulb seat 60 and which is secured relative to the bulb seat 60 to form a fourth electric contact 81, and a rear end 82 opposite to the front end in the axial direction and which is connected to the first electric contact 26. When the electrically conductive concentric tubes 50 are extended or shortened, the stretchable electrically conductive member 80 can be stretched or retracted in the axial direction.

The electric bulb 70 is disposed in the bulb seat 60, and has an outer threaded wall which is connected to the inner threaded wall 62 of the bulb seat 60 with a ring contact to be in electrical contact with the contact area, and a tip contact to be to be in electrical contact with the fourth electric contact 81 of the electrically conductive member 80.

The second electric contact 90 of the handle 20 includes a conducting plate 91, a conducting rod 92, and a conducting spring 93. The conducting plate 91 is disposed between the fastener 52 and the insulative block 53, and has an extension 911. The conducting rod 92 is disposed in the axial mounting groove 231, and has a third head end which is connected electrically to the extension 911 of the electrically conductive plate 91, and an opposite third tail end which is disposed in the first tail end of the handle 20 and which has a ring portion 921 disposed on the inner threaded wall 22. The conducting spring 93 is disposed in the first tail end of the handle 20, and has a fourth head end which is adapted to be connected electrically to the other one of the electrodes of the battery unit 30, and an opposite fourth tail end which has a connecting portion 932, and a contact portion 931 that extends diametrically and outwardly from the connecting portion 932 so as to be spaced apart from the ring portion 921 of the conducting rod 92 in a direction parallel to the axial direction.

Figure 7:
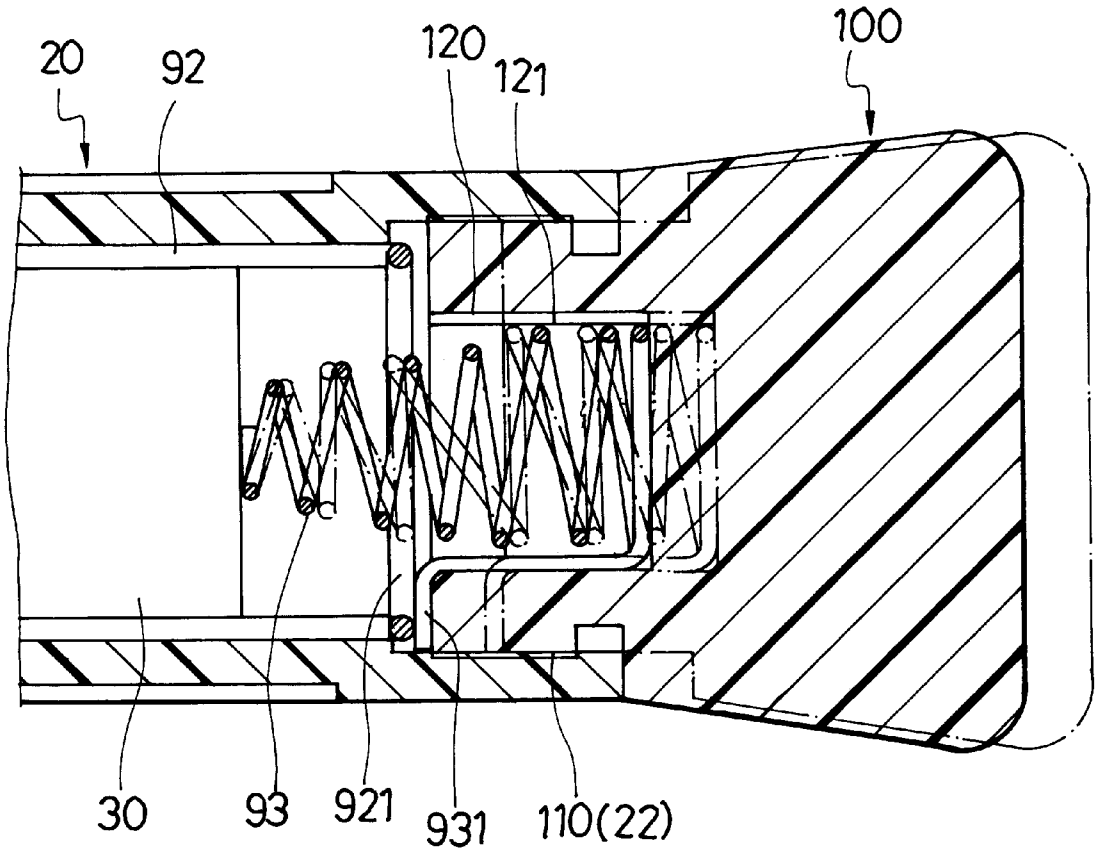
FIG. 7 is an enlarged view of a portion of the telescopic illuminating tool in use.

The switch member 100 is connected to the first tail end of the handle 20, and has an outer threaded wall 110 for engaging threadedly the inner threaded wall 22 so as to be rotatable about the axial direction relative to the handle 20. With reference to FIG. 7, the switch member 100 has a concavity 120 for receiving the conducting spring 93, and two axial slots 121 for receiving the contact portion 931 of the conducting spring 93. The connecting portion 932 of the conducting spring 93 abuts against a bottom of the concavity 120. As such, the switch member 100 can be rotated to move the contact portion 931 toward the ring portion 921 of the conducting rod 92 against a biasing force of the conducting spring 93 to make an electrical contact between the contact portion 931 and the ring portion 921.

Figure 5:
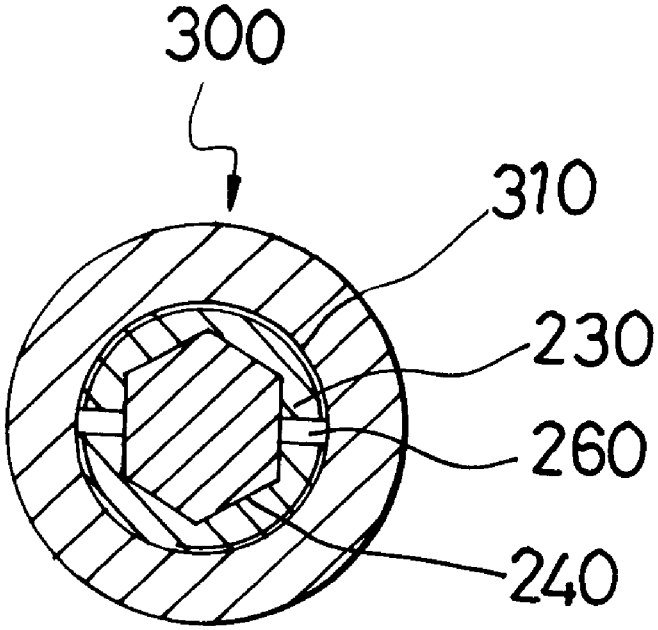
FIG. 5 is a partial cross-sectional view of the telescopic illuminating tool shown in FIG. 3, taken along lines 5—5 thereof.

With reference to FIG. 5, the tool member includes an adapter 200 which is made of a light-transmittable material, and which has an end connected threadedly to the bulb seat 60 and formed with a receiving recess 210 for receiving the electric bulb 70. The adapter 200 has an opposite threaded end 230 with a hexagonal hole 240 formed therein in the axial direction, and two axial slits 260 which are communicated with the hexagonal hole 240. A tool unit 400 has a hexagonal coupling end 410 which is inserted detachably into the hexagonal hole 240 of the adapter 200, and a magnet 420 opposite to the hexagonal coupling end 410 in the axial direction. A collet chuck mechanism 300 has a screw hole 310 with a diameter slightly smaller than that of the opposite threaded end 230 of the adapter 200, and sleeved threadedly on the opposite threaded end 230 to couple the tool unit 400 tightly onto the adapter 200.

Figure 6:
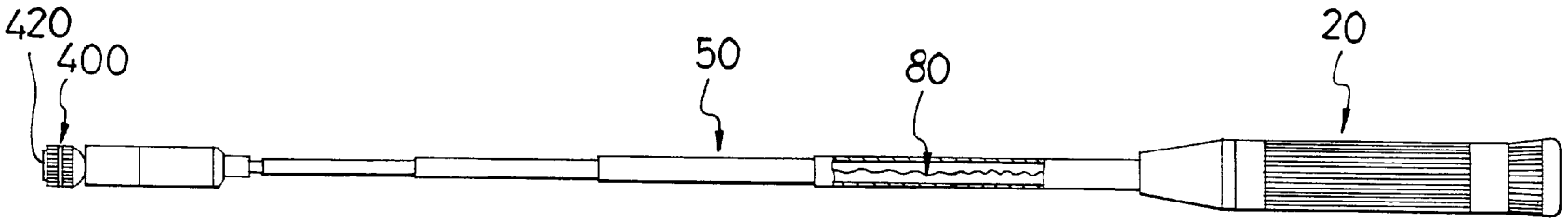
FIG. 6 is an assembled view of the preferred embodiment in an extended state.

In use, when the concentric tubes 50 are extended to stretch the electrically conductive member 80 in the axial direction, as shown in FIG. 6, the illuminating tool can be used to reach a narrow place to pick up an object. In addition, with reference to FIG. 3, when the switch member 100 is rotated inward of the handle 20 to establish electrical contact between the contact portion 931 and the ring portion 921, the tip contact of the bulb 70 is in electrical connection with one of the electrodes of the battery 30 via the electrically conductive member 80 and the first electric contact 26, while the ring contact of the bulb 70 is in electrical connection with the other one of the electrodes of the battery 30 via the contact area of the bulb seat 60, the concentric tubes 50, the fastener 52, the conducting plate 91, the conducting rod 92, and the conducting spring 93, thereby lighting the bulb 70. On the other hand, when the switch member 100 is rotated outwardly relative to the handle 20, the electric contact between the contact portion 931 and the ring portion 921 is broken to deactivate the bulb 70.

Note that the stretchable electrically conductive member 80 is made of a piano wire with a smaller diameter compared with an enameled wire and a larger extendable length, and is applied to connect the bulb 70 and the battery 30 without being sectioned, thereby facilitating assembly and fabrication of the conductive member 80.

Figure 8:
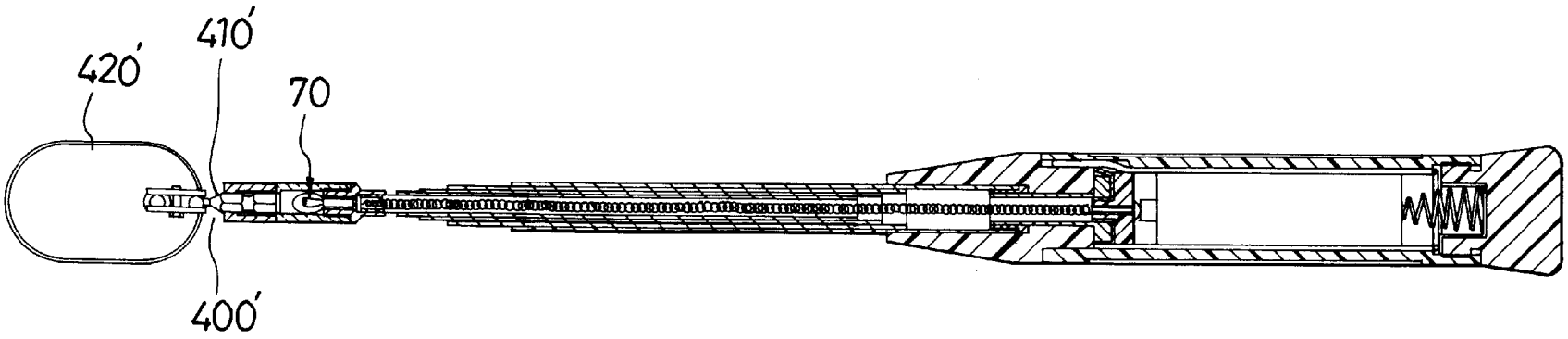
FIG. 8 illustrates a modified telescopic illuminating tool of this invention.

Referring to FIG. 8, a modified preferred embodiment of this invention is shown to be similar in construction to the previous embodiment, except that a mirror 420' is attached to the coupling end 410' of the tool unit 400' for reflecting purposes.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A telescopic illuminating tool, comprising:

a handle having a first head end, a first tail end opposite to said first head end in an axial direction, an accommodating chamber interposed therebetween and adapted to receive a battery unit which has two electrodes, a first electric contact disposed on said first head end and at a location in said axial direction, and a second electric contact insulatively spaced apart from said first electric contact in a radial direction, said first and second electric contacts being adapted to be connected electrically and respectively with the two electrodes of the battery unit;

a plurality of electrically conductive concentric tubes fitted telescopically and slidably one within another, said tubes forming an opened second head end, an opened second tail end opposite to said opened second head end in said axial direction, and a through hole extending from said opened second head end to said opened second tail end, said opened second tail end engaging said first head end and being electrically connected to said second electric contact;

a bulb seat connected to said opened second head end and distal to said opened second tail end, said bulb seat defining a contact area around said axial direction, and a third electric contact disposed to be spaced apart from said contact area in said radial direction, said third electric contact being in electrical connection with said opened second head end;

a stretchable electrically conductive member disposed securely in said through hole and insulated from said electrically conductive concentric tubes, said stretchable electrically conductive member having a front end that extends into said contact area of and that is secured relative to said bulb seat to form a fourth electric contact, and a rear end opposite to said front end in said axial direction and connected to said first electric contact such that said stretchable electrically conductive member will be stretched or retracted in said axial direction when said electrically conductive concentric tubes are extended or shortened;

an electric bulb disposed in said bulb seat to be lighted via an electrical contact between said third electric contact and said fourth electric contact; and a tool member disposed to be spaced from and forwardly of said electric bulb in said axial direction distal to said second head end.

2. The telescopic illuminating tool as claimed in claim 1, wherein said stretchable electrically conductive member is an electrically conductive tension spring wire sheathed with an electrically insulative sheath.

3. The telescopic illuminating tool as claimed in claim 2, further comprising an electrically insulative connecting member disposed between said second tail end of said concentric tubes and said first head end of said handle, said connecting member having a passage that extends therethrough in said axial direction and that is communicated with said through hole, and an electrically conductive fastener securing said opened second tail end to said first head end and in electrical connection with said opened second tail end and said second electric contact;

said first electric contact extending outwardly of said passage and into said through hole so as to be connected to said rear end of said stretchable electrically conductive member.

4. The telescopic illuminating tool as claimed in claim 3, further comprising a switch member disposed in and rotatable relative to said first tail end of said handle so as to be adapted to make or break electrical connection between said second electric contact of said handle and one of the electrodes of the battery unit.

5. The telescopic illuminating tool as claimed in claim 4, wherein said second electric contact of said handle includes:

a conducting rod disposed in said accommodating chamber, and having a third head end connected electrically to said electrically conductive fastener, and a third tail end opposite to said third head end in said axial direction and disposed in said first tail end of said handle; and a conducting spring disposed in said first tail end of said handle, and adapted to be mounted between the battery unit and said switch member, said conducting spring having a fourth head end adapted to be connected electrically to the other one of the electrodes of the battery unit, and a fourth tail end opposite to said fourth head end in said axial direction and including a connecting portion that abuts against said switch member and a contact portion that extends diametrically and outwardly from said connecting portion so as to be spaced apart from said third tail end of said conducting rod in a direction parallel to said axial direction;

said switch member being connected threadedly on said first tail end of said handle so as to be rotated about said axial direction to move said contact portion of said conducting spring toward said third tail end of said conducting rod against a biasing force of said conducting spring to make an electric contact between said contact portion and said third tail end.

6. The telescopic illuminating tool as claimed in claim 1, wherein said tool member includes:

an adapter made of a light-transmittable material, and having an end connected to said bulb seat and receiving said electric bulb; and a tool unit coupled detachably to an opposite end of said adapter and having an axis in said axial direction.

7. The telescopic illuminating tool as claimed in claim 6, wherein said tool member further includes a collet chuck mechanism to couple said tool unit detachably to said opposite end of said adapter.

8. The telescopic illuminating tool as claimed in claim 7, wherein said tool unit has a magnet oriented in said axis.

* * * * *